US006644827B2

(12) United States Patent
Birdwell

(10) Patent No.: US 6,644,827 B2
(45) Date of Patent: Nov. 11, 2003

(54) THIRD HAND FOR A FLASHLIGHT

(76) Inventor: Larry Birdwell, 5604 NE. St. ohns Rd., Vancouver, WA (US) 98661

( * ) Notice: Subject to any disclaimer, the term of this patent is extended or adjusted under 35 U.S.C. 154(b) by 0 days.

(21) Appl. No.: 10/016,267

(22) Filed: Dec. 10, 2001

(65) Prior Publication Data

US 2002/0048167 A1 Apr. 25, 2002

(51) Int. Cl.[7] ..... F21L 4/04

(52) U.S. Cl. ..... 362/202; 362/368; 362/190; 362/191; 362/197; 362/199; 362/388; 362/410; 362/427

(58) Field of Search ..... 362/202, 368, 362/190, 191, 197, 199, 388, 410, 427

(56) References Cited

U.S. PATENT DOCUMENTS

| | | | | |
|---|---|---|---|---|
| 1,367,369 A | | 2/1921 | Friend | |
| 1,598,559 A | | 8/1926 | Cohen | |
| 1,641,880 A | | 9/1927 | Cohen | |
| 3,325,639 A | | 6/1967 | King | |
| 3,418,461 A | | 12/1968 | Sedlock | |
| 4,399,498 A | | 8/1983 | Bacevius | |
| 4,528,622 A | | 7/1985 | Bacevius | |
| 4,533,982 A | | 8/1985 | Kozar | |
| 4,881,155 A | | 11/1989 | Gahagan | |
| 4,897,768 A | | 1/1990 | Thul | |
| 5,163,752 A | | 11/1992 | Copeland et al. | |
| 5,276,596 A | | 1/1994 | Krenzel | |
| 5,436,815 A | | 7/1995 | Grooms et al. | |
| 5,573,329 A | | 11/1996 | Van Gennep | |
| 5,580,157 A | | 12/1996 | Patricca et al. | |
| 5,593,074 A | | 1/1997 | Matthews | |
| 5,853,241 A | * | 12/1998 | Sharrah et al. | 215/52 |
| 5,931,560 A | * | 8/1999 | Hoffman | 362/124 |
| 6,158,876 A | * | 12/2000 | Birdwell | 362/208 |
| 6,206,542 B1 | * | 3/2001 | Case et al. | 362/190 |

* cited by examiner

*Primary Examiner*—Sandra O'Shea
*Assistant Examiner*—Bertrand Zeade
(74) *Attorney, Agent, or Firm*—Birdwell, Janke & Durando, PLC

(57) ABSTRACT

A third hand for a flashlight. A flashlight holder adapted for receiving the flashlight that includes provision for stabilizing the flashlight loosely on a support surface or temporarily and releasably attaching the flashlight to a support surface or object. The flashlight holder is pivotally connected through a first swivel joint to an elongate joint arm at one end thereof, and a mounting mechanism is pivotally connected through a second swivel joint to the joint arm at the other end thereof. Preferably, the joint arm includes two arm portions coupled together by a third swivel joint. The mounting mechanism includes a variety of attachment devices.

22 Claims, 6 Drawing Sheets

THIRD HAND FOR A FLASHLIGHT

BACKGROUND OF THE INVENTION

This invention relates to a third hand for a flashlight or the like, particularly for adjustably holding the flashlight in a selected one of a plurality of positions and orientations, relieving the hands.

Mechanics, installers, repairpersons and the like commonly have the need to apply portable lighting to their work and, particularly, to aim a beam of light, such as from a flashlight, on a particular portion of the work while the hands remain free to perform operations on the work or to hold tools. It is therefore often desired to adjustably and temporarily fix the flashlight or other light source in space at a particular location and orientation. However, the light must be attached to or rest upon something if it is not held by the worker's hand, and it is not generally the case that the work or site has a specialized provision for this purpose.

A common but inconvenient solution to this problem is for the worker to hold the butt of the flashlight in his or her mouth. A variation on this concept is exemplified by Sedlock, U.S. Pat. No. 3,418,461, wherein a bracket is provided on the flashlight having a mouthpiece for clenching between the user's teeth.

Bacevius, U.S. Pat. No. 4,399,498, provides a clamp housing, one end of which is adapted to receive a flashlight or lantern and the other end of which defines a clamping jaw, and a complementary movable jaw biased with a spring means. The span opening or distance between the gripping jaws can be adjusted for clamping onto surfaces having variable cross sectional shapes. While it is asserted that a wide range of jaw opening is provided, the range of suitable supports remains limited. Moreover, angular adjustment of the direction of the light is also limited in range as well as being limited to one axis.

Thul, U.S. Pat. No. 4,897,768, provides an arcuate track that is mountable with suction cups to a supporting surface. A flashlight is strapped to the track at a selected location and, therefore, inclination. A drawback of the device is that varying the inclination requires two hands for manipulating the strap. Another drawback is that, without removing the suction cups from the support surface, the inclination is adjustable only about one axis. Yet another drawback is that a support surface sufficiently flat and large to receive widely spaced-apart suction cups is required.

Van Gennep, U.S. Pat. No. 5,573,329, provides a clamping pliers carrying a ball and socket joint for a flashlight holder. A disadvantage of clamping pliers is that they are generally limited to clamping onto objects that can be gripped with a relatively small jaw opening, and may cause damage to some of objects, particularly if misadjusted.

King, U.S. Pat. No. 3,325,639, provides a base for a high-intensity light. The base includes a suction cup having a magnet secured therein, providing a choice between magnetic and suction mounting. A ball and socket joint is proposed for connecting a pivoting arm of the light to the base. While providing additional flexibility in mounting and movement, the device requires a surface suitable for receiving the magnet or the suction cup, as there are no alternative provisions for supporting the light.

Accordingly, there is a need for a third hand for a flashlight that provides for attachment to, or stabilization upon, a wide variety and range of support objects and surfaces, and provides a wide range of positional and directional adjustability obtained with a minimum of repositioning.

SUMMARY OF THE INVENTION

The present invention solves the aforementioned problems and meets the aforementioned needs by providing a third hand for a flashlight comprising a flashlight holder adapted for receiving the flashlight that includes provision for stabilizing the flashlight loosely on a support surface or temporarily and releasably attaching the flashlight to a support surface or object. The flashlight holder is pivotally connected through a first swivel joint to an elongate joint arm at one end thereof, and a mounting mechanism is pivotally connected through a second swivel joint to the joint arm at the other end thereof. The mounting mechanism comprises a variety of attachment devices including a suction cup, a magnet and a threaded member. The flashlight holder comprises a plurality of stabilizing devices including one or more pivotally connected leg members.

Preferably, the back surface of the suction cup is spring biased against the end of the mounting mechanism, and the end of the mounting mechanism is adapted to bear against the back surface at points spaced along the outer periphery thereof, to provide maximum stiffness in the joint formed between the mounting mechanism and the flexible suction cup.

Preferably, the joint arm is provided in portions that are coupled together with a third swivel joint, providing 360 degree relative rotation of the portions about a selected axis. Preferably, the third swivel joint is, and more preferably, all the swivel joints are provided with a self-locking or "ratchet" feature that can be overcome with a predetermined amount of torque.

Accordingly, it is a principal object of the present invention to provide a novel third hand for a flashlight.

It is another object of the present invention to provide a third hand for a flashlight that provides attachment to, or stabilization upon, a wide variety and range of support objects and surfaces.

It is yet another object of the present invention to provide a third hand for a flashlight that provides a wide range of positional and directional adjustability.

It is still another object of the present invention to provide a third hand for a flashlight that provides a wide range of positional and directional adjustability with a minimum of repositioning.

The foregoing and other objects, features and advantages of the invention will be more readily understood upon consideration of the following detailed description of the invention, taken in conjunction with the following drawings.

DETAILED DESCRIPTION OF THE PREFERRED EMBODIMENTS

Figures 1, 2:
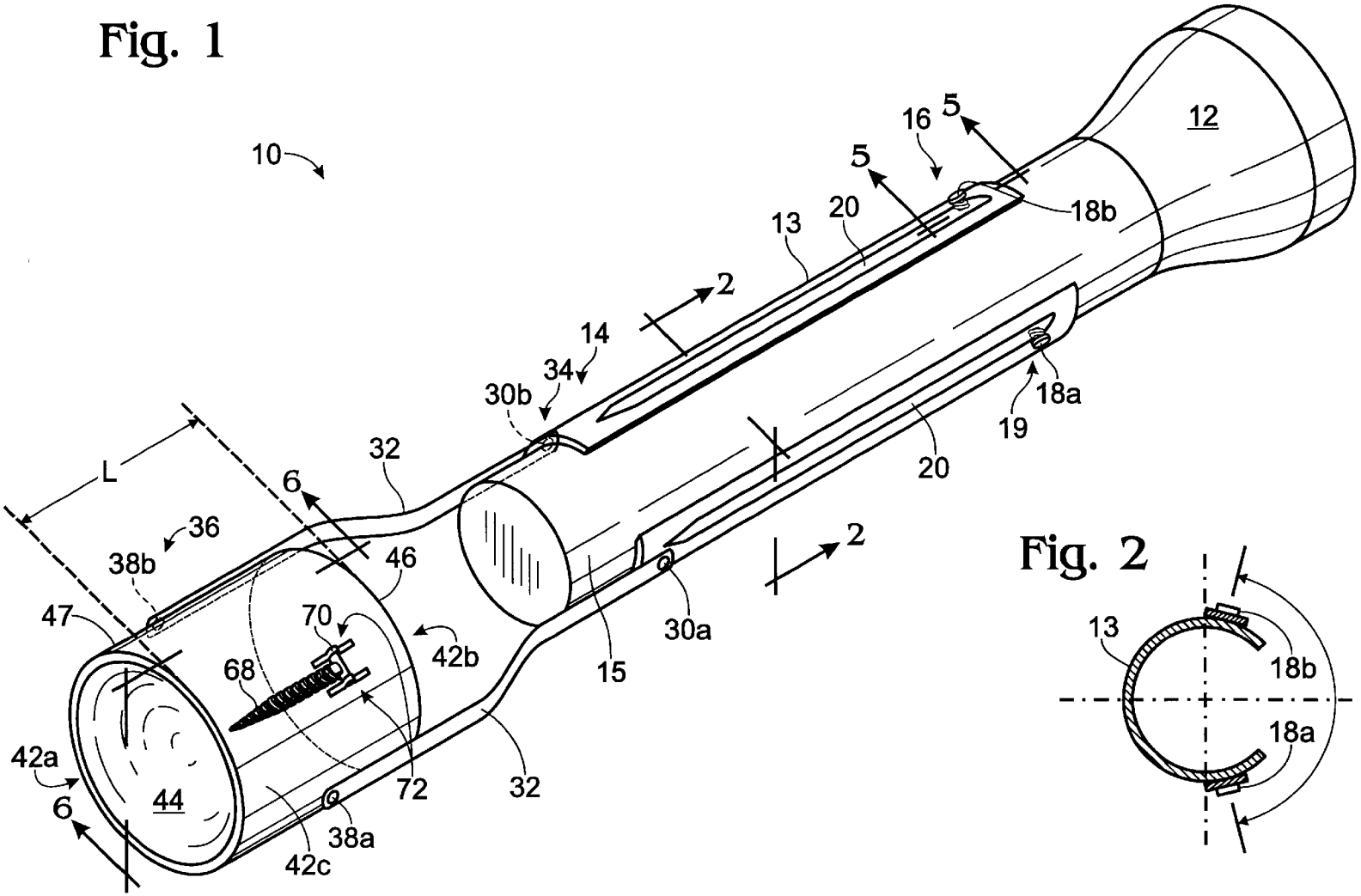
FIG. 1 is a pictorial view of a third hand for a flashlight according to the present invention in a first configuration, with legs thereof in a stowed position.
FIG. 2 is a sectional view of the third hand of FIG. 1, taken along a line 2—2 thereof.

FIG. 1 depicts a third hand 10 for a flashlight 12 according to the present invention. As will be apparent from the disclosure below, the third hand 10 is capable of being configured for holding the flashlight in a wide range of positions and orientations, only one of which is shown in FIG. 1. A preferred flashlight 12 is marketed by Mag Instrument, Inc. of Ontario, Calif. under the trademark MAG-LITE ("MagLite"). The MagLite has a cylindrical body portion adapted for gripping by the user; however, it will be understood that the third hand 10 may be employed with flashlights or other lights having other configurations or cross-sectional shapes as well.

Referring to FIG. 1, the third hand 10 has a flashlight holder 14 that is adapted for receiving the flashlight 12. For the MagLite, the flashlight holder has a semi-cylindrical body portion 13 adapted to conform to the cylindrical body 15 of the light. The flashlight holder may be formed of any suitable material and is preferably metal or plastic.

The flashlight holder 14 includes, at one end 16 thereof, two pivot joints 18*a* and 18*b* projecting radially from the holder. Referring to FIG. 2, it is preferable that the joints 18*a* and 18*b* are not diametrically opposed to one another, i.e., they are less than 180 degrees apart from one another, though this is not an essential feature of the invention.

Figure 3:
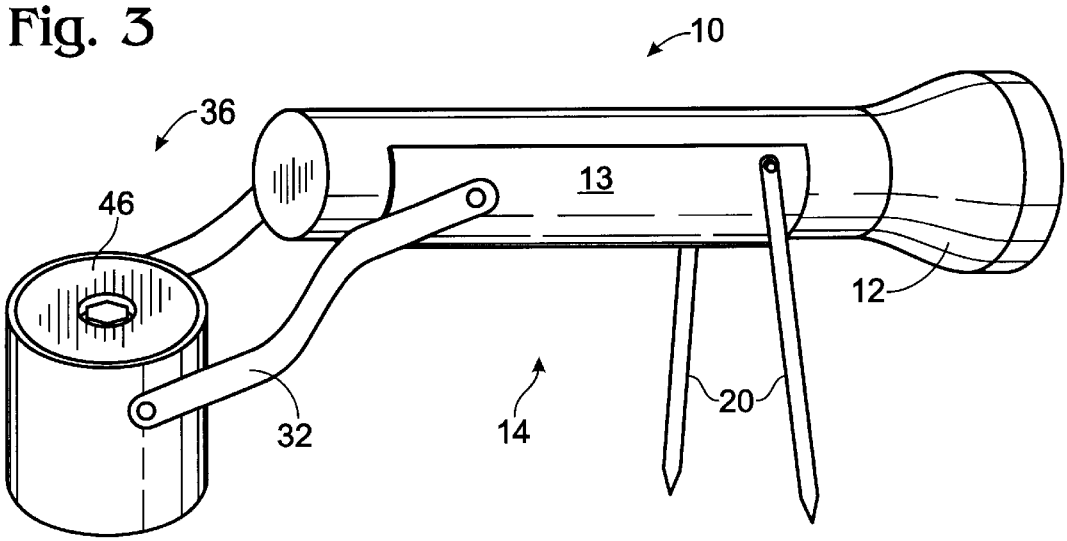
FIG. 3 is a pictorial view of the third hand of FIG. 1, showing the legs in an open position.

The joints 18*a* and 18*b* are adapted to receive respective stabilizing devices, particularly respective ends 19 of two elongate legs 20. The legs are independently pivotal at the joints between a stowed position, as shown in FIG. 1, wherein the legs lie substantially flush along the body of the flash-light holder, to an open position, shown in FIG. 3, wherein the legs project away from the flash-light holder. The legs in combination with the flash-light and flashlight holder preferably form a tripod in the open position. The stance of the tripod so formed is enlarged because the legs splay outwardly from one another in their open positions, due to the aforementioned asymmetry of the position of the joints 18*a* and 18*b*.

Figure 5:
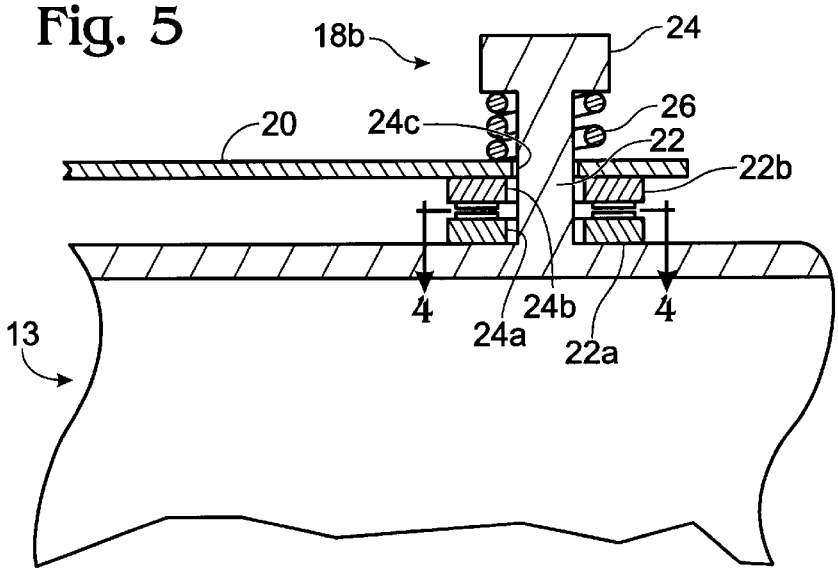
FIG. 5 is a sectional view of the third hand of FIG. 1, taken along a line 5—5 thereof.
Figure 4:
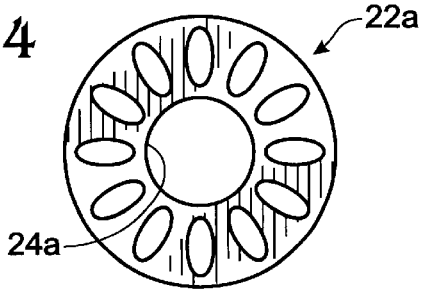
FIG. 4 is a plan view of a ribbed washer for use with the present invention.

The joints 18*a* and 18*b*, though permitting the legs 20 to pivot, should also to some extent resist pivoting so that they maintain their selected positions under the weight of the third hand loaded with the flashlight 12. A simple friction joint may be employed; however, a preferred embodiment of the joints 18*a* and 18*b* employs two ribbed washers for each joint. A plan view of a ribbed washer 22*a* is shown in FIG. 4. Turning to FIG. 5, one of two similar ribbed washers 22*a* and 22*b* is fixedly attached to the end 16 of the flashlight holder, and the other of the washers is fixedly attached to the end 19 of the leg 20. By way of illustration but not of limitation, for plastic parts 14 and 20, the ribbed washers may be insert molded therein and, for metal parts 14 and 20, the ribbed washers may be spot welded, soldered or brazed thereto or thereon.

A post 22 extends from the body portion 13 of the flashlight holder through apertures 24*a*, 24*b* and 24*c* respectively in the washers and in the leg 20. The post 22 has a cap 24 that captures a compression spring or spring washer 26 for biasing the ribbed washers together. The ribbed washers provide for a two-way ratcheting action that holds the legs firmly in a selected one of a number of discrete positions.

Referring back to FIG. 1, an opposite end 28 of the flashlight holder 14 employs two pivot joints 30*a* and 30*b* for pivotally attaching respective elongate joint arms 32 to the flashlight holder. The arms are attached to the flashlight holder at ends 34 thereof The pivot joints 30*a* and 30*b* are similar to the joints 18*a* and 18*b* and preferably employ the ribbed washer construction described above in connection with FIG. 3.

A mounting mechanism 36 is provided for carrying a plurality of attachment devices. The mounting mechanism is shown with a circular shape, however, this is not a functional requirement. The mounting mechanism includes two pivot joints 38*a* and 38*b* for pivotally attaching the arms 32 at ends 40 thereof. The pivot joints 38*a* and 38*b* are similar to the joints 18*a* and 18*b* and preferably employ the ribbed washer construction described above in connection with FIG. 3. The joints 30*a*, 30*b*, 38*a* and 38*b* provide a compound linkage between the flashlight holder 14 and the mounting mechanism 36, permitting an exceptionally high degree of adjustment of the inclination and position of the flashlight holder with respect to the mounting mechanism.

The arms 32 are sufficiently long, with respect to the length "L" of the mounting mechanism, to permit the mounting mechanism to be pivoted over 360 degrees about the joints 38*a* and 38*b* without interfering with the flashlight 12 when it is in the flashlight holder 14. This provides for either of two ends 42*a*, 42*b* of the mounting mechanism to be oriented away from the flashlight 14.

As one of the attachment devices, a suction cup 44 is attached at one of the ends 42*a* of the mounting mechanism 36. As another of the attachment devices, a magnet 46 is attached to the other end 42*b* of the mounting mechanism. As yet another of the attachment devices, a threaded member 68 is attached to a side 42*c* of the mounting mechanism.

Figure 6:
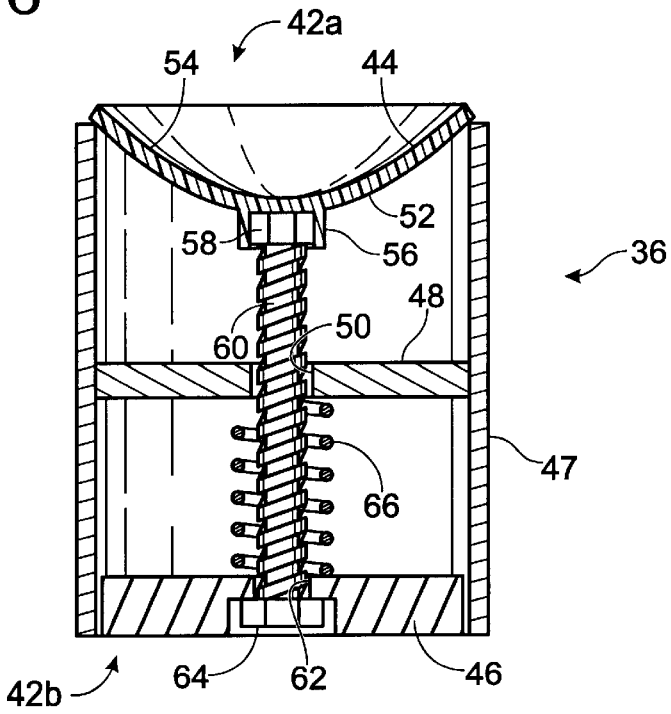
FIG. 6 is a sectional view of the third hand of FIG. 1, taken along a line 6—6 thereof, showing a suction cup in a relaxed and fully biased position.

The magnet 46 may be obtained as a standard product available through hardware stores, such as that marketed by Master Magnetics, Inc. of Castle Rock, Colo., under the trademark THE MAGNET SOURCE. Referring to FIG. 6, the magnet includes an aperture 62 therethrough for mounting the magnet to the mounting mechanism 36.

The suction cup 44 may also be obtained as a standard product available through hardware stores, such as that marketed by W. C. Winks Hardware of Portland, Oreg. The suction cup includes a base portion 56 in which a nut or a bolt 58 is fixedly installed for mounting the suction cup to the mounting mechanism. The suction cup 44 and magnet 46 may be simply fixedly attached to the respective ends 42*a* and 42*b*, extending therefrom. However, additional advantages may be obtained with the structure described next.

The mounting mechanism has a housing 47 and a landing 48 is preferably disposed within the housing, which divides the housing between the ends 42*a* and 42*b*. The landing includes an aperture 50 therethrough. By way of illustration but not of limitation, for a plastic mounting mechanism, the housing and landing may be molded together, and for a metal housing, the landing may be a washer welded, soldered or brazed therein.

The suction cup has a back surface 52 and a front surface 54 that are, respectively, convex and concave when the suction cup is in its relaxed, as-molded configuration. A threaded member 60, such as a machine screw, extends through the aperture 50 in the landing toward the end 42*a* and is threaded into the nut 58 of the suction cup, capturing the suction cup on the side of the landing proximate the end 42*a*. The threaded member 60 is also passed through the aperture 62 in the magnet 46, and has a cap 64 that is larger than the aperture 62 so that the magnet is captured on the side of the landing proximate the end 42*b*. The movable assembly formed by the threaded member 60, the suction cup 44 and the magnet 46 is spring biased with a compression spring 66 toward the end 42*b* relative to the end 42*a*. The movable assembly is moved, by pressing the magnet toward the landing, to extend the suction cup for use. Certain conditions desirable for providing this feature and for taking advantage of it are described next.

The diameter of the mounting mechanism 36 at the end 42*b* is preferably larger than the diameter of the magnet 46, so that the end 42*b* may receive the magnet when the magnet is depressed toward the landing 48, extending the suction cup 44 away from the end 42*a*. However, the magnet may extend from the end 42*b* when the movable assembly is in its fully biased position, and therefore be any size, without departing from the principles of the invention.

Figure 7:
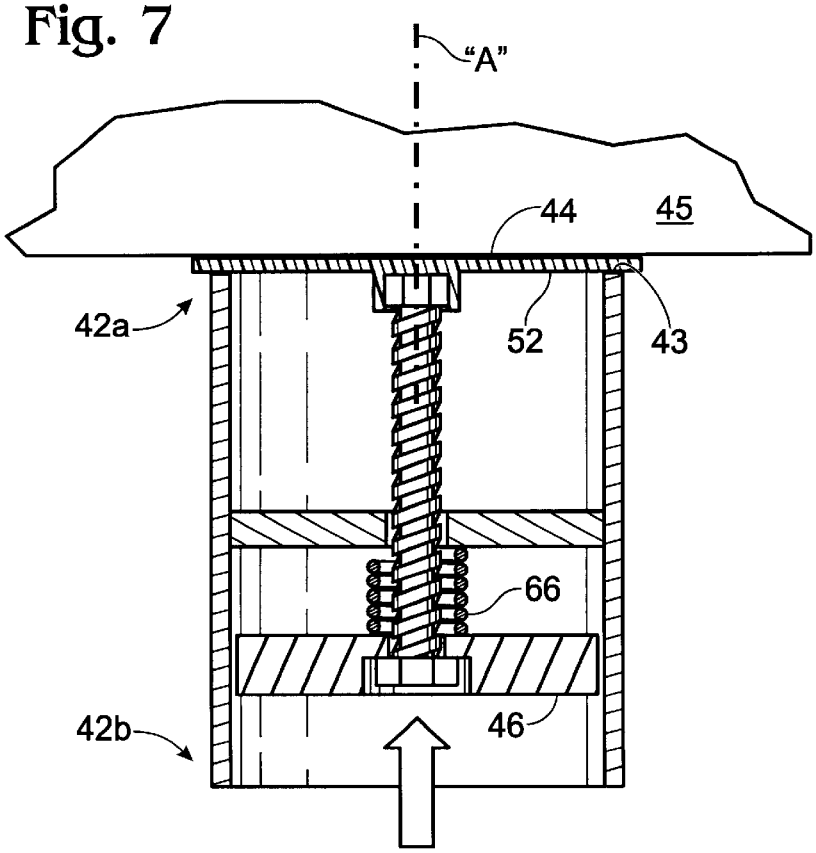
FIG. 7 is a sectional view of the third hand of FIG. 1, taken along the line 6—6, showing a suction cup attached to a mounting surface.

Preferably, the threaded member 60 is adapted in length so that the suction cup in its relaxed configuration is at least partially withdrawn inside the end 42*a* when the movable assembly is in its fully biased position. Referring to FIG. 7, the movable assembly may be pressed against the spring bias to extend the suction cup from the end 42*a*, flattening the suction cup against a support surface 45 to obtain suction. The outer periphery of the suction cup 44 is preferably at least slightly larger than the diameter of the mounting mechanism 36 at its end 42*a*, when the suction cup is in its flattened configuration. This provides for an outstanding advantage. Upon releasing the movable assembly, an edge portion 43 of the end 42*a* is forced to bear against the back surface 52 near the outer periphery of the suction cup by the spring bias. This protects the surface on which the suction cup is mounted from damage by the mounting mechanism, and at the same time provides a relatively large moment for resisting bending induced separation between the suction cup and the mounting mechanism 36.

The movable assembly also permits rotating the mounting mechanism and, therefore, the flashlight holder, about the elongate axis "A" of the threaded member 60 so that, when either the magnet or the suction cup is attached to the surface 45, the flashlight holder may be rotated about an axis perpendicular to the surface without detaching the magnet or suction cup from the surface. This movement in conjunction with pivoting at the joints 30*a*, 30*b*, 38*a* and 38*b*, provides an outstanding range of motion for adjusting the orientation and position of the flashlight, all while the third hand is temporarily attached to the surface 45.

Referring back to FIG. 1, the side 42*c* of the mounting mechanism 36 employs a pivot joint 70 for pivotally attaching the threaded member 68, which may be a sheet metal screw, to the mounting mechanism. The pivot joint 70 is similar to the joints 18*a* and 18*b* and preferably employs the ribbed washer construction described above in connection with FIG. 3. However, the pivot joint 70 employs two lugs 72 extending from the side 42*c*. By way of illustration but not of limitation, the lugs may be molded or cast in the mounting mechanism, or joined therewith, such as by welding. The threaded member may be extended for screwing into an available wood surface or support, where that is desirable.

The third hand 10 provides the capability to position and aim the flashlight 12 freely with respect to the most effective mechanism for attachment or stabilization under a given set of conditions. The mounting mechanism 36 may be pivoted about the pivot joints 38*a* and 38*b* and, independently, the arms 32 may be pivoted about the pivot joints 30*a* and 30*b*, pivoting the mounting mechanism about the body portion 13 of the flashlight holder. Moreover, the various stabilizing and attachment devices may also be independently manipulated into a variety of positions, by pivoting the legs about the pivot joints 18*a* and 18*b*, translating or rotating the movable assembly with respect to the mounting mechanism, and pivoting the threaded member 68 about the pivot joint 70.

As just one example of the range of positional and orientational flexibility provided by the third hand, two legs 20 in their open position provide two points of a tripod for stabilizing the flashlight holder on a support surface as was discussed above. The third point of the tripod, however, may be one of a number of choices selected by particularly configuring the third hand. For example, the arms 32 could be pivoted about the pivot joints 30*a* and 30*b* to move the mounting assembly out of the way so that the end of the flashlight body would provide the third point of the tripod. Alternatively, the arms could be pivoted so as to employ the mounting assembly as the third point of the tripod. A particular point on the mounting assembly could further be selected by pivoting the mounting assembly about the pivot points 38*a* and 38*b*. All of these different choices provide for differing heights and stances for the tripod, which can be combined with variations in the position of the legs to obtain innumerable configurations for a tripod for holding the flashlight under the widest range of conditions. It should be apparent from this example, and from all of the foregoing, that the third hand provides for attachment to, or stabilization upon, a wide variety and range of support objects and surfaces, and provides a wide range of positional and directional adjustability with a minimum of repositioning.

Figures 8, 9:
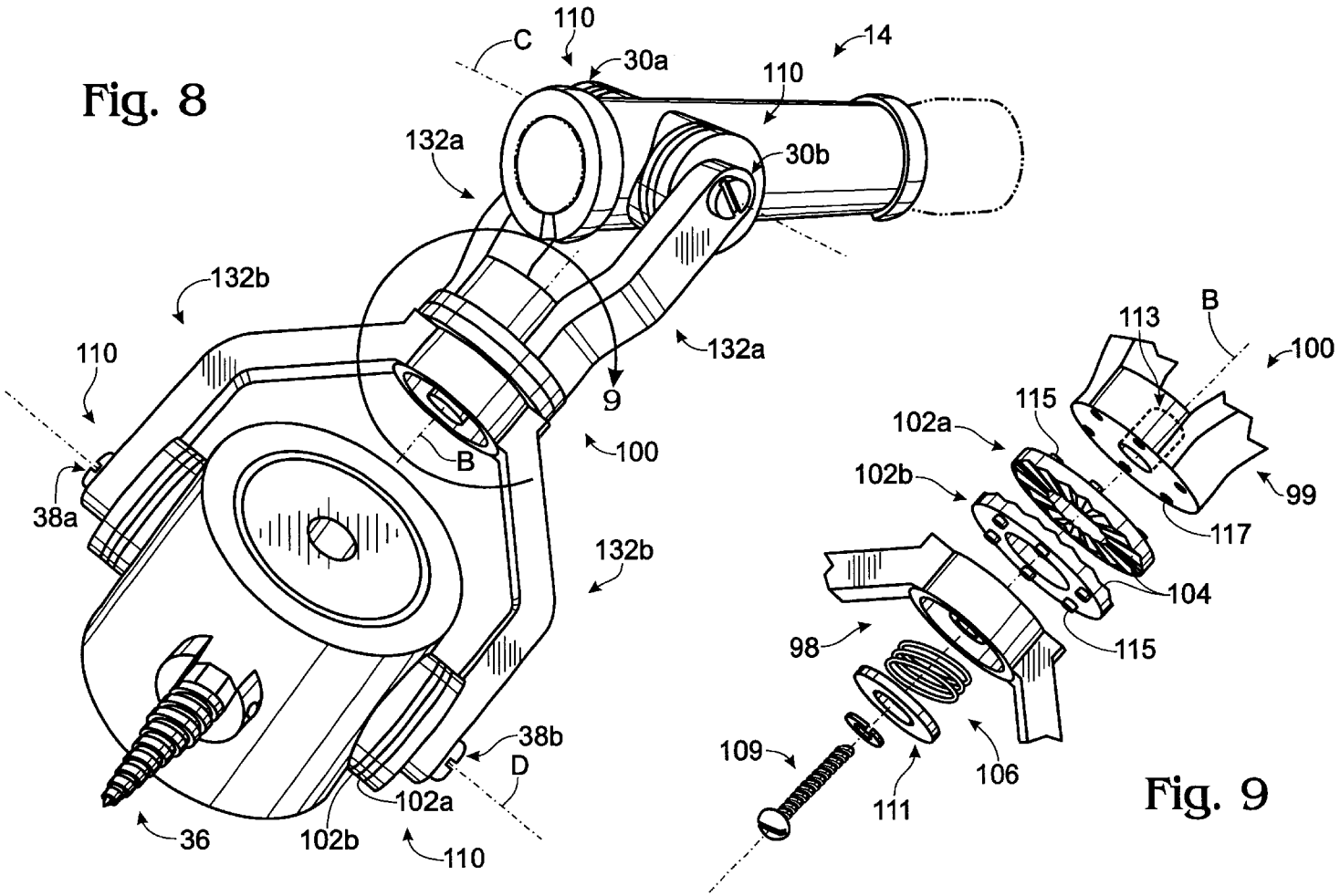
FIG. 8 is a pictorial view of a second embodiment of a third hand for a flashlight according to the invention.
FIG. 9 is an exploded view of a swivel joint of the third hand of FIG. 8.

Turning to FIG. 8, a preferred commercial embodiment of the third hand 10 is shown. This embodiment includes an additional swiveling feature, but omits the aforementioned legs 20. In this embodiment, the aforementioned joint arms 32 each comprise an opposed pair of arm portions 132*a* and 132*b*, which are coupled to one another through a swivel joint 100, adapted to permit relative rotation of the two arm portions about an axis "B". As the third hand will function with only one arm 32, there need not be two arm portions 132*a* or 132*b* as pictured even though this is highly desirable.

Similar or identical swivel joints 110 are also advantageously provided at the pivot points 30*a* and 30*b*, between the arm portions 132*a* and the holder 14, and the pivot joints 38*a* and 38*b* between the arm portions 132*b* and the mounting mechanism 36. Note that the orientation of the axis "B" is alterable with respect to the holder 14 and the mounting mechanism 36, respectively, by rotating one or both of similar swivel joints 110 about respective axes "C" and "D."

Figure 10A:
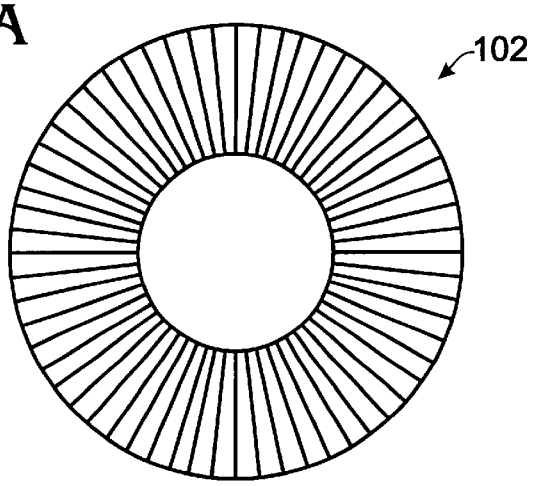
FIG. 10A is a plan view of a ratchet disc for use in the swivel joint of FIG. 9.
Figure 10B:
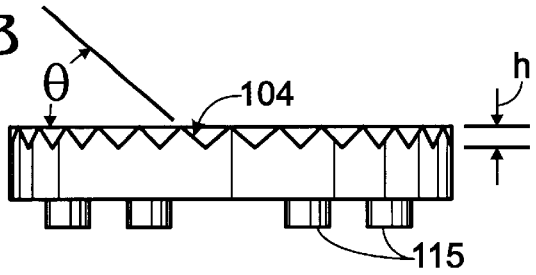
FIG. 10B is a side view of the ratchet disc of FIG. 10A.

Referring to FIG. 9, showing the joint 100 exploded, the joint includes mating ratchet discs 102*a* and 102*b* with radially extending teeth 104, which are shown in more detail in FIGS. 10A and 10B. The ratchet discs are forced together by a compression spring 106 so that the teeth 104 of each ratchet disc interlock, normally preventing swiveling of the swivel joint 100. However, the teeth are ramped, as can be seen in FIG. 10B, in cross-section to permit the teeth to slide over one another and thereby permit relative rotation of the ratchet discs, against the spring-bias of the spring 106, by application of sufficient torque. The compression spring 106 acts to press one ratchet disc against another by bearing against one of the ratchet discs 102*a* and acting on the other through a mounting mechanism 108 comprising a bolt 109 and washer 111 at one end 98 of the joint 100, cooperating with a threaded aperture 113 at the other end 99 of the joint, for capturing the spring and the ratchet discs therebetween. Each ratchet disc is coupled to its respective end 98 and 99 to prevent relative rotation therebetween, e.g., by the use of projections 115 adapted to fit into corresponding apertures 117 in the ends.

The ramp angle "θ" and height "h" of the teeth (FIG. 10B), as well as the number of the teeth, can be varied along with the spring constant of the spring 106, to adjust the amount of torque required to turn the ratchet discs relative to one another. Preferably, these parameters are selected so that the ratchet discs resist relative rotation under the weight of the flashlight in any desired articulation of the arms 132, where any attachment device is being used, on any surface; however, the ratchet discs permit relative rotation with the application of greater torque to permit angular adjustment by the user. The ratchet discs could perform their function without the teeth 104, merely relying on friction therebetween, without departing from the principles of the invention.

Figure 11:
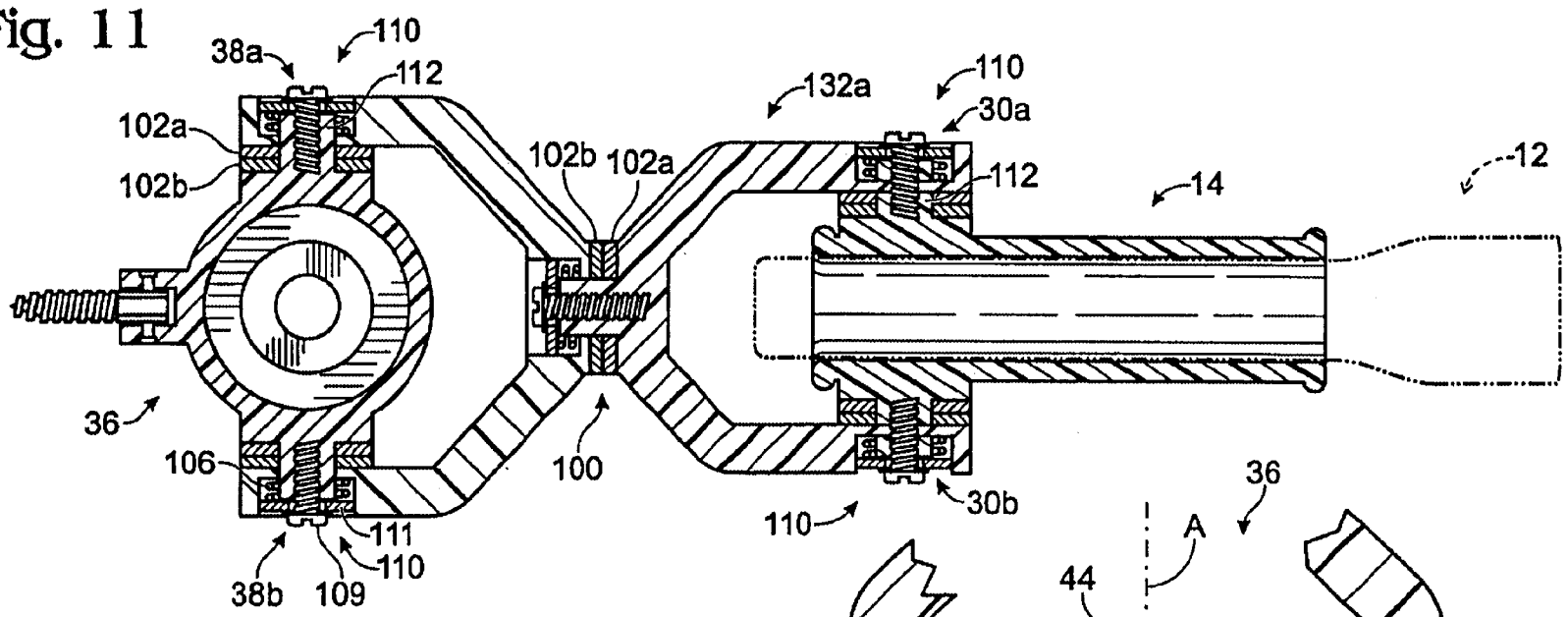
FIG. 11 is a section view of the entire third hand of FIG. 8, taken in such a way as to bisect each of five swivel joints according to the invention.

Turning to FIG. 11, as mentioned, the swivel joints 110 for pivoting the arm portions with respect to the holder and mounting mechanism may be be similar or are preferably identical to the swivel joint 100. The bolt 109 is threaded into an aperture 113 in a projection 112 that is attached to or integrally formed with the respective holder or mounting mechanism. As one exemplary alternative, for any of the swivel joints, the projection 112 may be adapted to replace the bolt 109 by including provision for receiving a snap ring at the location of the head of the bolt 109.

In addition to providing a positive locking feature, the ratchet discs 102 may be easily and economically replaced by the user, providing an outstanding feature of the invention.

Figure 13A:
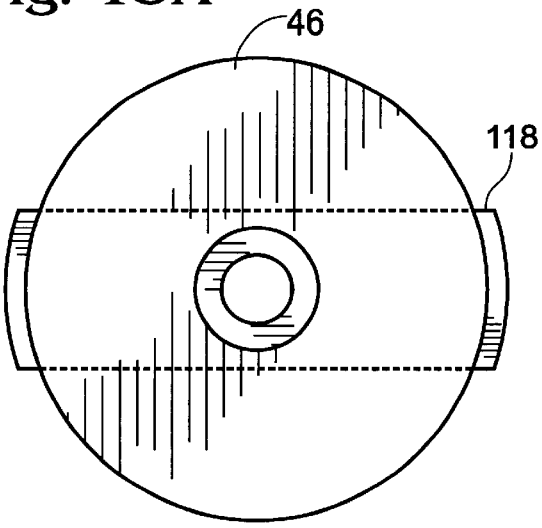
FIG. 13A is a plan view of a magnet and keying bracket for use in the mounting mechanism of FIG. 12 according to the present invention.
Figure 13B:
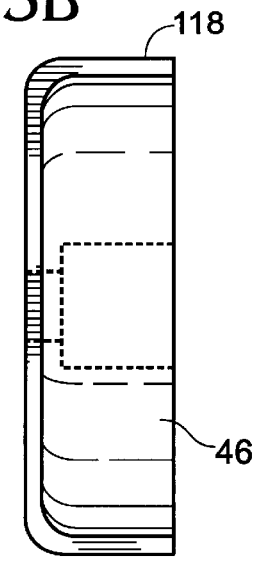
FIG. 13B is a side view of the magnet and keying bracket if FIG. 13A.
Figure 12:
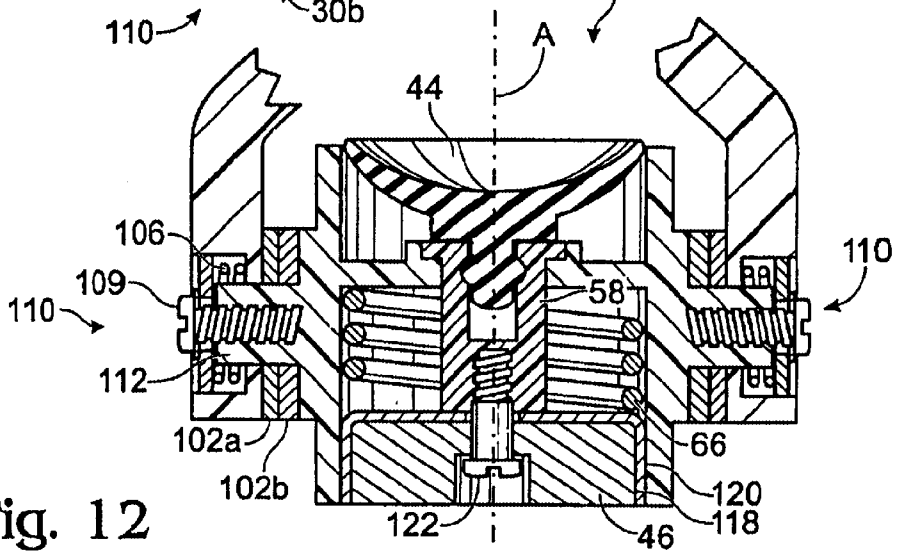
FIG. 12 is a longitudinal section view of a mounting mechanism portion of the third hand of FIG. 8 according to the present invention, bisecting two swivel joints according to the invention.

Turning to FIG. 12, the magnet 46 is preferably held against axial rotation about the axis "A" relative to the mounting mechanism 36 by a keying bracket 118, shown also in FIGS. 13A and 13B, that is received in mating keyways 120 provided in the mounting mechanism. The keying bracket may be adhesively bonded to the magnet. Where the magnet is used as the attachment device, the third hand 10 may be swiveled, if desired, about the axis "A" of the mounting mechanism 36, by sliding the magnet on the surface to which it is attached, or detaching the magnet from the surface and reorienting the magnet for reattachment.

As mentioned, the suction cup 44 is preferably exposed for use by depressing the magnet 46; otherwise, the suction cup is held inside the mechanism 36 as a result of the bias of the spring 66. In contrast to the magnet 46, the suction cup 44 is preferably provided with the ability to swivel about the axis "A" relative to the rest of the mechanism 36. This may be achieved by use of a shoulder bolt 122 extending through the magnet 46, which is free to rotate with respect to the magnet. The shoulder bolt extends into a threaded post 58 of the suction cup, or to which the suction cup is attached, so that the suction cup is also free to rotate with respect to the magnet and, therefore, the mounting mechanism 36. Thence, when the suction cup is used as the attachment device, the third hand 10 may be swiveled about the axis "A" of the mounting mechanism 36 simply by grasping the third hand 10 and rotating it.

The keyways 120 are extended to receive the keying bracket 118 over the entire course of its travel, along the axis "A," for exposing the suction cup 44 from the opposite end of the mounting mechanism.

It is to be recognized that, while particular third hand for a flashlight according to the present invention has been shown as preferred, other configurations could be utilized, in addition to configurations already mentioned, without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

I claim:

1. A third hand for a flashlight, comprising:

a holder adapted for holding the flashlight;

a mounting mechanism including a plurality of attachment devices adapted for removably attaching the mounting mechanism to a support;

a first arm portion connected to said flashlight holder with a first swivel joint at a first end of said first arm portion to permit relative rotation of said first arm portion and said holder about a first axis; and a second arm portion connected to said mounting mechanism with a second swivel joint at a first end of said second arm portion to permit relative rotation of said second arm portion and said mounting mechanism about a second axis and by said rotation to orient a selected one of said attachment devices in a selected direction, wherein said first and second arm portions are connected to each other with a third swivel joint to permit relative rotation thereof about a third axis.

2. The third hand of claim 1, wherein, regardless of the amount of said rotation about said first axis, said third axis is not parallel to said first axis.

3. The third hand of claim 2, wherein, regardless of the amount of said rotation about said second axis, said third axis is not parallel to said second axis.

4. The third hand of claim 2, wherein, regardless of the amount of said rotation about said first axis, said third axis is substantially perpendicular to said first axis.

5. The third hand of claim 4, wherein, regardless of the amount of said rotation about said second axis, said third axis is substantially perpendicular to said second axis.

6. The third hand of claim 2, wherein, regardless of the amount of said rotation about said first axis, said third axis always intersects said first axis.

7. The third hand of claim 6, wherein, regardless of the amount of said rotation about said second axis, said third axis always intersects said second axis.

8. The third hand of claim 1, wherein said third swivel joint comprises two mating surfaces and a spring biasing said surfaces together, wherein said surfaces and said spring are adapted to permit said surfaces to rotate relative to one another upon application of a torque that rises to a predetermined level, and to prevent relative rotation where said torque is less than said predetermined level.

9. The third hand of claim 8, wherein said surfaces include respective complementary ratchet teeth adapted to mesh with one another and thereby lock one of said surfaces to the other, said teeth further being adapted to rampingly slide on each other when said torque rises to said predetermined level.

10. The third hand of claim 9, wherein said surfaces are part of respective discs, wherein said third swivel joint is adapted so that said discs are independently removable therefrom.

11. The third hand of claim 1, wherein said second swivel joint comprises two mating surfaces and a spring biasing said surfaces together, wherein said surfaces and said spring are adapted to permit said surfaces to rotate relative to one another upon application of a torque that rises to a predetermined level, and to prevent relative rotation where said torque is less than said predetermined level.

12. The third hand of claim 11, wherein said surfaces include respective complementary ratchet teeth adapted to mesh with one another and thereby lock one of said surfaces to the other, said teeth further being adapted to rampingly slide on each other when said torque rises to said predetermined level.

13. The third hand of claim 12, wherein said surfaces are part of respective discs, wherein said second swivel joint is adapted so that said discs are independently removable therefrom.

14. The third hand of claim 1, wherein said first swivel joint comprises two mating surfaces and a spring biasing said surfaces together, wherein said surfaces and said spring are adapted to permit said surfaces to rotate relative to one another upon application of a torque that rises to a predetermined level, and to prevent relative rotation where said torque is less than said predetermined level.

15. The third hand of claim 14, wherein said surfaces include respective complementary ratchet teeth adapted to mesh with one another and thereby lock one of said surfaces to the other, said teeth further being adapted to rampingly slide on each other when said torque rises to said predetermined level.

16. The third hand of claim 15, wherein said surfaces are part of respective discs, wherein said second swivel joint is adapted so that said discs are independently removable therefrom.

17. The third hand of claim 10, wherein said second swivel joint comprises two mating surfaces and a spring biasing said surfaces of said second swivel joint together, wherein said surfaces of said second swivel joint and said spring of said second swivel joint are adapted to permit said surfaces of said second swivel joint to rotate relative to one another upon application of a torque that rises to a predetermined level, and to prevent relative rotation where said torque is less than said predetermined level for said second swivel joint, wherein said surfaces of said second swivel joint include respective complementary ratchet teeth adapted to mesh with one another and thereby lock one of said surfaces of said second swivel joint to the other, said teeth for said second swivel joint further being adapted to rampingly slide on each other when said torque rises to said predetermined level for said second swivel joint, wherein said surfaces of said second swivel joint are part of respective discs of said second swivel joint, wherein said second swivel joint is adapted so that said discs of said second swivel joint are independently removable therefrom.

18. The third hand of claim 17, wherein said discs of said second swivel joint are substantially identical to said discs of said third swivel joint.

19. The third hand of claim 17, wherein said first swivel joint comprises two mating surfaces and a spring biasing said surfaces of said first swivel joint together, wherein said surfaces of said first swivel joint and said spring of said first swivel joint are adapted to permit said surfaces of said first swivel joint to rotate relative to one another upon application of a torque that rises to a predetermined level, and to prevent relative rotation where said torque is less than said predetermined level for said first swivel joint, wherein said surfaces of said first swivel joint include respective complementary ratchet teeth adapted to mesh with one another and thereby lock one of said surfaces of said first swivel joint to the other, said teeth for said first swivel joint further being adapted to rampingly slide on each other when said torque rises to said predetermined level for said first swivel joint, wherein said surfaces of said first swivel joint are part of respective discs of said first swivel joint, wherein said first swivel joint is adapted so that said discs of said first swivel joint are independently removable therefrom.

20. The third hand of claim 19, wherein said discs of said first swivel joint and said discs of said second swivel joint and said discs of said third swivel joint are all substantially identical.

21. A third hand for a flashlight, comprising:

a holder adapted for holding the flashlight;

a mounting mechanism adapted for removable attachment to a support;

a first arm portion connected to said flashlight holder with a first swivel joint at a first end of said first arm portion to permit relative rotation of said first arm portion and said holder about a first axis; and a second arm portion connected to said mounting mechanism with a second swivel joint at a first end of said second arm portion to permit relative rotation of said second arm portion and said mounting mechanism about a second axis and by said rotation to orient a selected one of said attachment devices in a selected direction, wherein said first and second arm portions are connected to each other with a third swivel joint to permit relative rotation thereof about a third axis, wherein, regardless of the amount of said rotation about said first axis, said third axis is substantially perpendicular to said first axis.

22. The third hand of claim 21, wherein, regardless of the amount of said rotation about said second axis, said third axis is substantially perpendicular to said second axis.

* * * * *